US008261645B2

(12) United States Patent
Dale

(10) Patent No.: US 8,261,645 B2
(45) Date of Patent: Sep. 11, 2012

(54) LOG REST

(75) Inventor: Peter Dale, Kilworthy (CA)

(73) Assignee: Norwood Industries, Inc., Ontario (CA)

( * ) Notice: Subject to any disclaimer, the term of this patent is extended or adjusted under 35 U.S.C. 154(b) by 0 days.

(21) Appl. No.: 12/917,298

(22) Filed: Nov. 1, 2010

(65) Prior Publication Data

US 2011/0132166 A1 Jun. 9, 2011

(30) Foreign Application Priority Data

Dec. 8, 2009 (CA) ..... 2687623

(51) Int. Cl.

| | |
|---|---|
| ***B26D 7/04*** | (2006.01) |
| ***B26D 7/01*** | (2006.01) |
| ***B27B 29/00*** | (2006.01) |
| ***B27B 1/00*** | (2006.01) |

(52) U.S. Cl. ..... 83/466.1; 83/468.1; 83/468.2; 83/468.4; 83/788; 83/453; 144/242.1; 144/245.1; 144/378

(58) Field of Classification Search ..... 144/177, 144/178, 209.1, 214, 242.1, 245.1, 245.6, 144/250.12, 250.13, 250.2, 253.7, 376, 378, 144/162.1; 83/466.1, 468.1, 468.2, 468.4, 83/794, 795, 821, 825, 827–829, 788, 453

See application file for complete search history.

(56) References Cited

U.S. PATENT DOCUMENTS

| | | | | |
|---|---|---|---|---|
| 2,504,373 | A * | 4/1950 | Andrews et al. | 269/210 |
| 3,374,812 | A * | 3/1968 | McManama | 83/466 |
| 3,695,316 | A | 10/1972 | Pluckhahn | |
| 3,797,349 | A * | 3/1974 | Smith | 83/404.1 |
| 3,926,086 | A | 12/1975 | Crane | |
| 3,965,788 | A | 6/1976 | Granberg | |
| 4,210,049 | A | 7/1980 | Gauthier | |
| 4,235,140 | A * | 11/1980 | Reece | 83/794 |
| 4,245,535 | A | 1/1981 | Lockwood et al. | |
| 4,275,632 | A | 6/1981 | Ross | |
| 4,300,428 | A | 11/1981 | Woodland | |
| 4,307,641 | A | 12/1981 | Shapleigh | |
| 4,559,858 | A * | 12/1985 | Laskowski et al. | 83/801 |
| 4,640,170 | A | 2/1987 | Bakken | |
| 5,035,166 | A * | 7/1991 | Carlson et al. | 83/801 |
| 5,243,892 | A | 9/1993 | Jindra | |
| 5,784,941 | A * | 7/1998 | Sanborn | 83/794 |
| 5,806,401 | A * | 9/1998 | Rajala et al. | 83/865 |
| 6,895,843 | B1 * | 5/2005 | Hurdle, Jr. | 83/23 |
| 2006/0117926 | A1 | 6/2006 | Dale et al. | |
| 2007/0234869 | A1 | 10/2007 | Dale et al. | |

FOREIGN PATENT DOCUMENTS

| | | |
|---|---|---|
| CA | 1200180 A1 | 2/1986 |
| CA | 2541734 A1 | 10/2007 |

OTHER PUBLICATIONS

"Sawmill, portable sawmills, mobile sawmills, band sawmills, portable band sawmills, bandmills, Norwood", printed from http://www.norwoodindustries.com/en/Home_Norwood_Sawmills.aspx on Oct. 29, 2010, 4 pages.

"Blades & Blade Material", printed from http://www.norwoodindustries.com/en/content/Products.aspx on Oct. 29, 2010, 4 pages.

* cited by examiner

*Primary Examiner* — Ghassem Alie

(57) ABSTRACT

A new log support and clamp system (log rest) for a portable sawmill, having a log rest and a log dog. The log rest features a ratcheting, quick-adjustable, self-locking clamp which improves the ability of the user to affix the log in place for sawing. Also, a portable sawmill having such a log rest.

6 Claims, 8 Drawing Sheets

LOG REST

CROSS REFERENCE TO RELATED APPLICATION

This application claims priority under 35 U.S.C. §119 to Canadian Patent Application Number 2,687,623, filed Dec. 8, 2009, the disclosure of which is incorporated herein by reference in its entirety.

FIELD OF THE INVENTION

The present invention relates to a new log support system (log rest) for a portable sawmill. The log rest features a ratcheting, adjustable clamp which improves the ability of the user to affix the log in place for sawing.

BACKGROUND OF THE INVENTION

There are several prior inventions for portable sawmills.

U.S. Pat. No. 5,784,941 describes a portable sawmill in which the functions of adjusting a cut and making a cut are divided between two separate devices. The invention discloses a vertical chain saw, ideally operated in an upward direction. The patent also discloses a log restraint system comprising a setwork having a headstock and a lockable L-shaped log dog, joined by a clamp which is locked with a lever.

U.S. Pat. No. 5,243,892 discloses a portable sawmill with a frame base and an inverted U-shaped frame, supported by a carriage rolling along side tracks defined by the frame base. In use, the log is placed on the U-shaped frame and clamped with a tubular clamp held within a sleeve and locked in place using threaded blocks.

U.S. Pat. No. 4,640,170 discloses a portable saw mill with a frame that surrounds the log. The frame is dragged or slid along a frame supporting surface. The frame holds a chain saw at the two ends of its blade, in horizontal fashion, with chain saw support members. The invention uses sliding means for facilitating the movement of the frame over the log. The log is secured against rolling using a simple jig or similar means.

U.S. Pat. No. 4,275,632 describes a portable sawmill comprising a U-shaped support or carriage, holding a band saw. When in use, a log is placed between the two guide rails and is supported in place by appropriately distanced log supports.

U.S. Pat. No. 4,307,641 describes a portable sawmill comprising two skid rails, vertical support members, a pair of guide rails. The log is held in place by two externally threaded log screw pins with pointed ends.

U.S. Pat. No. 4,300,428 describes a portable sawmill having a frame, a guide member mounted above the frame, and a carriage. The chain saw is mounted above the log, and operates at about a 45 degree angle to the horizontal. The log is held in place with log dogs which are adapted for hooking the log and holding it in position.

U.S. Pat. No. 4,235,140 describes a saw mill. The logs are held in place with a standard log dog attached to the cross members on which the log is placed.

U.S. Pat. No. 3,965,788 describes a saw guide for use with a vertically operated portable chain saw. The saw guide apparatus is attached directly to the log.

U.S. Pat. No. 3,926,086 describes a portable saw mill that uses a complex pulley system to move the chain saw and supporting platform. When in use, a log is placed, and clamped, between the guide rails, using a set of circular discs eccentrically oriented on a rod.

U.S. Pat. No. 3,695,316 describes a portable timber milling jig that uses a carriage, holding a chain saw, axially surrounding a square guide rail. The chain saw is held at an approximately 45 degree angle and only uses one guide rail, and utilizes ball bearings on the carriage to move the carriage with respect to the guide rail. When in use, a log is placed under the guide rail, and fixed using clamping points driven into the center of the log, to which support clamps are fastened.

Canadian Patent No. 1,200,180 describes a portable saw mill comprising a frame with a guide rail and a carriage moveable along the guide rail. A band saw is supported by the carriage. The carriage is moveable along the guide rail along two sets of wheels, one engaged with the upper side of the guide rail and the other with the lower side. The log is held in place by its own weight, or by stops and a traditional locking dog.

U.S. Pat. No. 4,245,535 describes a portable sawmill with an elaborate hydraulic apparatus for cutting a log. The chain saw cuts in a vertical motion. The log is held in place using a log holding assembly having a toothed prod which grips the outer end of the log, and a cylinder which impales the inner end of the log with a ram, forcing the outer end against the prod.

U.S. Pat. No. 4,210,049 describes an "x" frame for holding a log, with a chain saw affixed to the frame in cantilever position for cutting logs crosswise. The log is held in the nook of the "x" frame.

Canadian patent application 2,541,734 describes a portable sawmill that is easily displaceable, easily assembled and disassembled into portable components, and which can use generic components as its saw and/or guide rails. The log is held in place using traditional log dogs.

SUMMARY OF THE INVENTION

The present invention provides a log support and clamp assembly for use in a portable sawmill, comprising a horizontal support beam having two ends for affixing to a sawmill, the support beam capable of being affixed to said sawmill at both ends. A log dog having a vertical portion generally perpendicular to said horizontal support beam and extending upwards therefrom, and a top end having a pick protruding therefrom. A log rest assembly having a clamp housing affixed to said support beam and horizontally displaceable thereof, a post connected to or housed within said clamp housing, said post configured in a generally vertical direction and said clamp housing having a ratchet mechanism for raising the post relative to the horizontal support beam.

In one embodiment, the post has a wheel at a top end. In another embodiment the wheel has a rotatable, lockable cuff. The cuff may have a jagged edge.

In one embodiment, the log support and clamp assembly can be in an unlocked position, the log dog horizontally displaceable along the horizontal support beam, and in a locked position, the log dog horizontally non-displaceable along the horizontal support beam. In another embodiment, in an unlocked position, the log dog is vertically displaceable relative to the horizontal support beam, and in a locked position, the log dog is vertically non-displaceable relative to the horizontal support beam.

Optionally, the log dog has a log dog handle extending at an upwards angle from the top end.

In an embodiment, the log support and clamp assembly has a lever attached to a pawl in said ratchet mechanism, wherein a movement of said lever releases said pawl and lowers said post.

The present invention also teaches a portable sawmill comprising the log support and clamp assembly, as well as a kit for retrofitting a log support and clamp assembly to a portable sawmill.

DETAILED DESCRIPTION OF THE PREFERRED EMBODIMENTS

The present invention provides a simple, versatile, cost-effective and portable log support system for a sawmill such as a portable sawmill. The system provides exemplary fixing of the log onto it, and allows for a user to clamp the log in place on the log support/clamp utilizing only one hand. This permits the user to use the other hand to stabilize the log until the log rest is ratcheted into the desired position, and the log clamped between the log rest and the log dog, a cam-operated clamp that squeezes the log. The log rest is thus the back-stop against which the log rests and against which the log dog exerts force, thereby clamping the log. The log rest thus allows the user to quickly raise and lower its height to suit the log being milled. The log rest can be raised or lowered with one hand, and, when being raised, the log rest automatically locks in place.

The log rest is particularly suitable for portable sawmills, and for use by hunters, "do-it-yourselfers", and people situated in remote areas, who need to saw boards, clapboards, shingles, etc., since it allows for a highly variable log size to be affixed to it, and it allows for a single operator to maneuver the log into place, then clamp the log in place using only one hand to operate the clamp mechanism. This allows the user to use their other hand to stabilize the log, greatly improving use and safety of a sawmill, for example, when a single person, in a remote area, is sawing logs. The log rest also allows great flexibility in the size of logs being clamped to it, thanks to its highly adjustable nature. Notably, the log rest can be adjusted to a rough log sizing, then fine adjusted for each individual log in an easy, one-handed manner. The operator, using only one hand, can raise the log rest to suit the log size, and it automatically locks in place. Additionally, the operator can lower it one-handed by flicking a lever.

The log rest design enables it to be sold as part of a sawmill such as a portable saw mill, or as a separate item for retrofitting onto an existing sawmill, for example, as a kit or an accessory option. The log rest's design enables it to be manufactured from extremely sturdy, reasonably inexpensive materials, and permits a high level of configurability for different size logs.

An embodiment of the present invention will now be described as shown in FIGS. 1-8.

Figure 1:
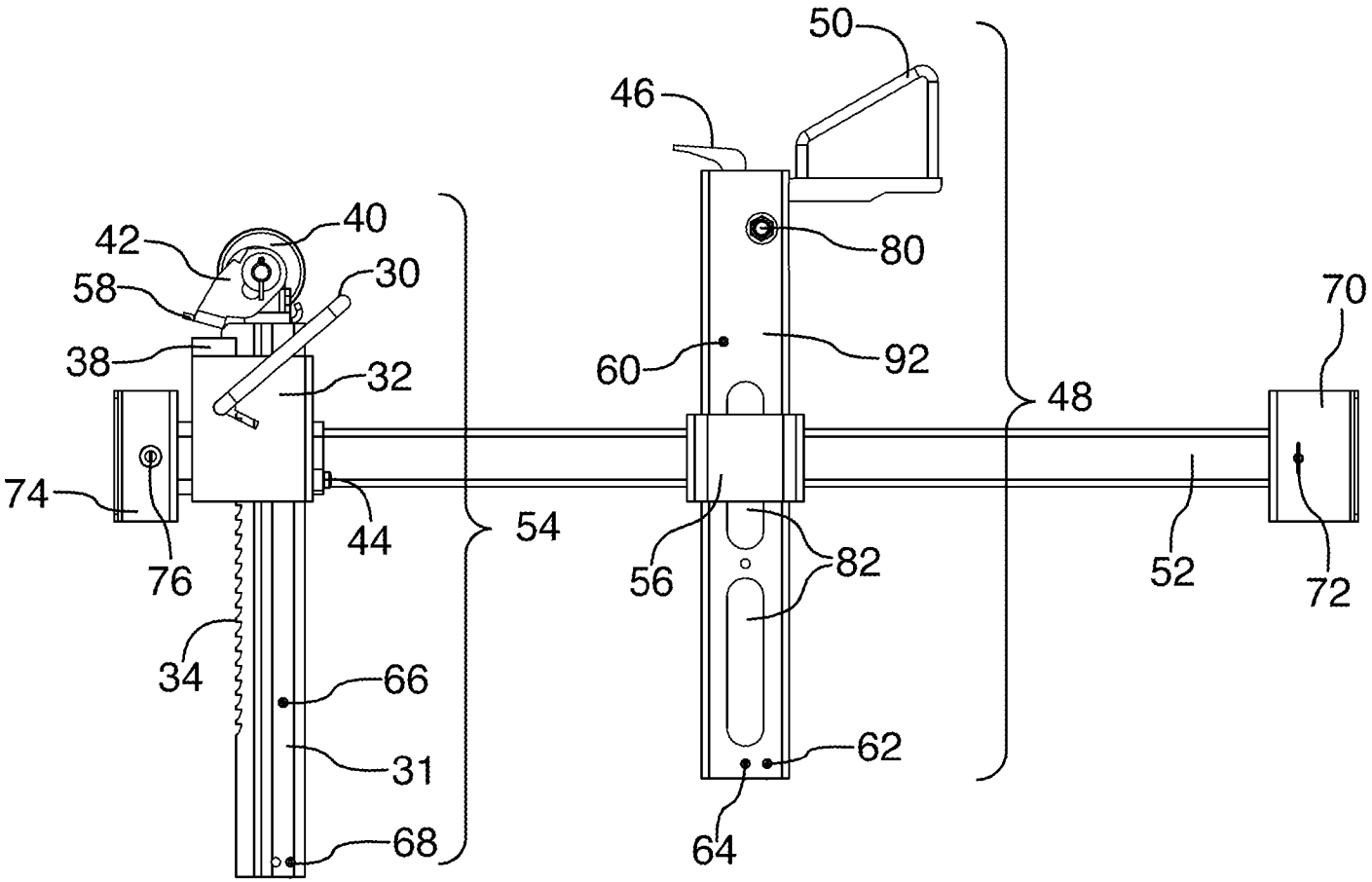
FIG. 1 is a side elevation illustration of the log support system in isolation from the sawmill.
Figure 8:
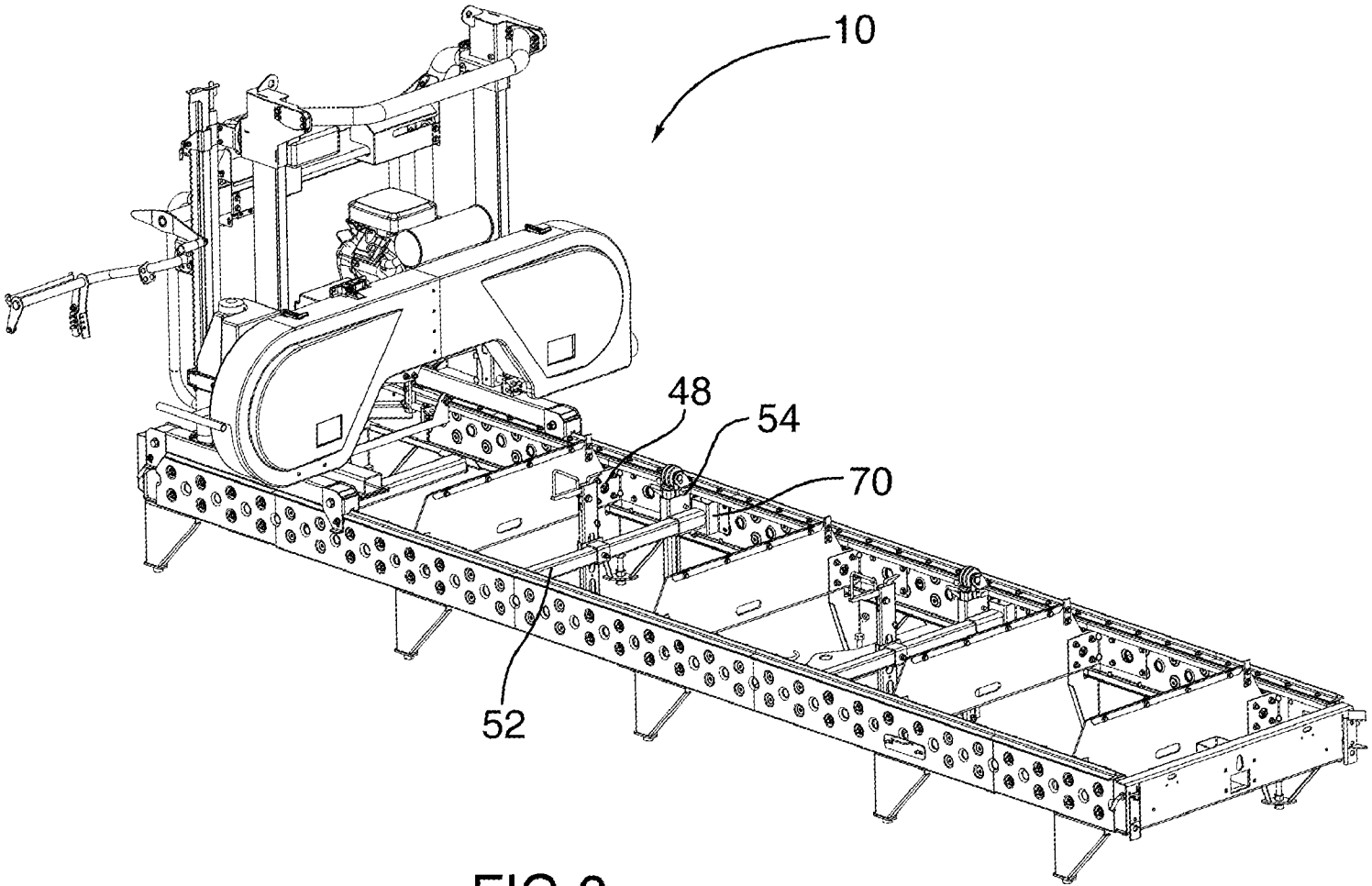
FIG. 8 shows a front perspective view of a sawmill with the log rest in context.

As seen in FIGS. 1 and 8, the log support/clamp system comprises a support beam 52 designed to be affixed to the sawmill 10 through sawmill supports 70, 74. Attached to support beam 52 are log dog 48 and log rest 54. The design is such that the sawmill supports 70, 74 can be affixed to opposing sides of the sawmill by screwing them thereto utilizing screw holes 78. Log dog 48 and log rest 54 can then be easily affixed to or removed from the sawmill through removal of sawmill support pin 72, lateral displacement of the support beam 52 through sawmill support opening 84, then displacement of the log dog 48 and log rest 54 beyond the end of support beam 52.

Figure 2:
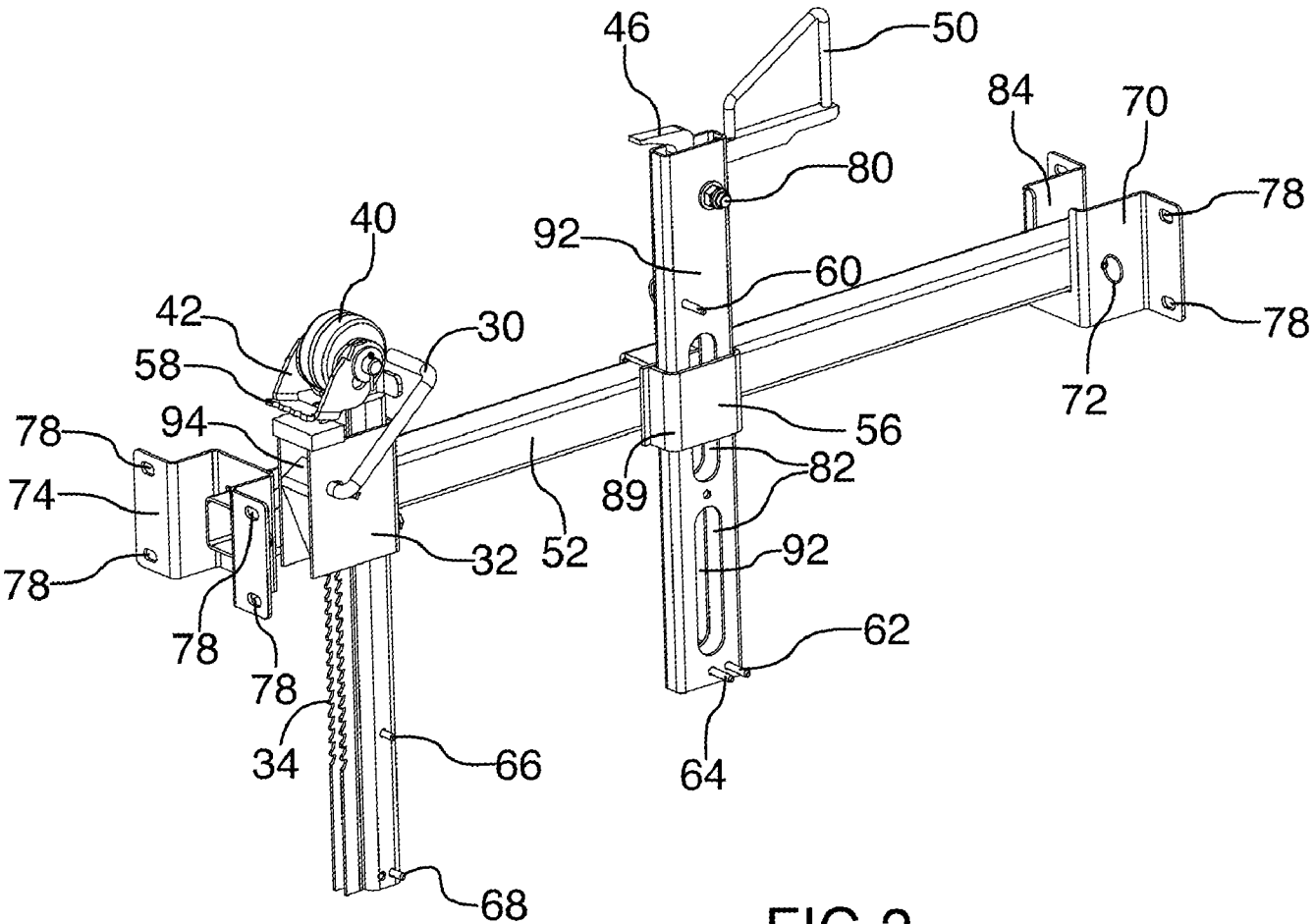
FIG. 2 shows a front perspective view of the log support/clamping system of FIG. 1.
Figure 3:
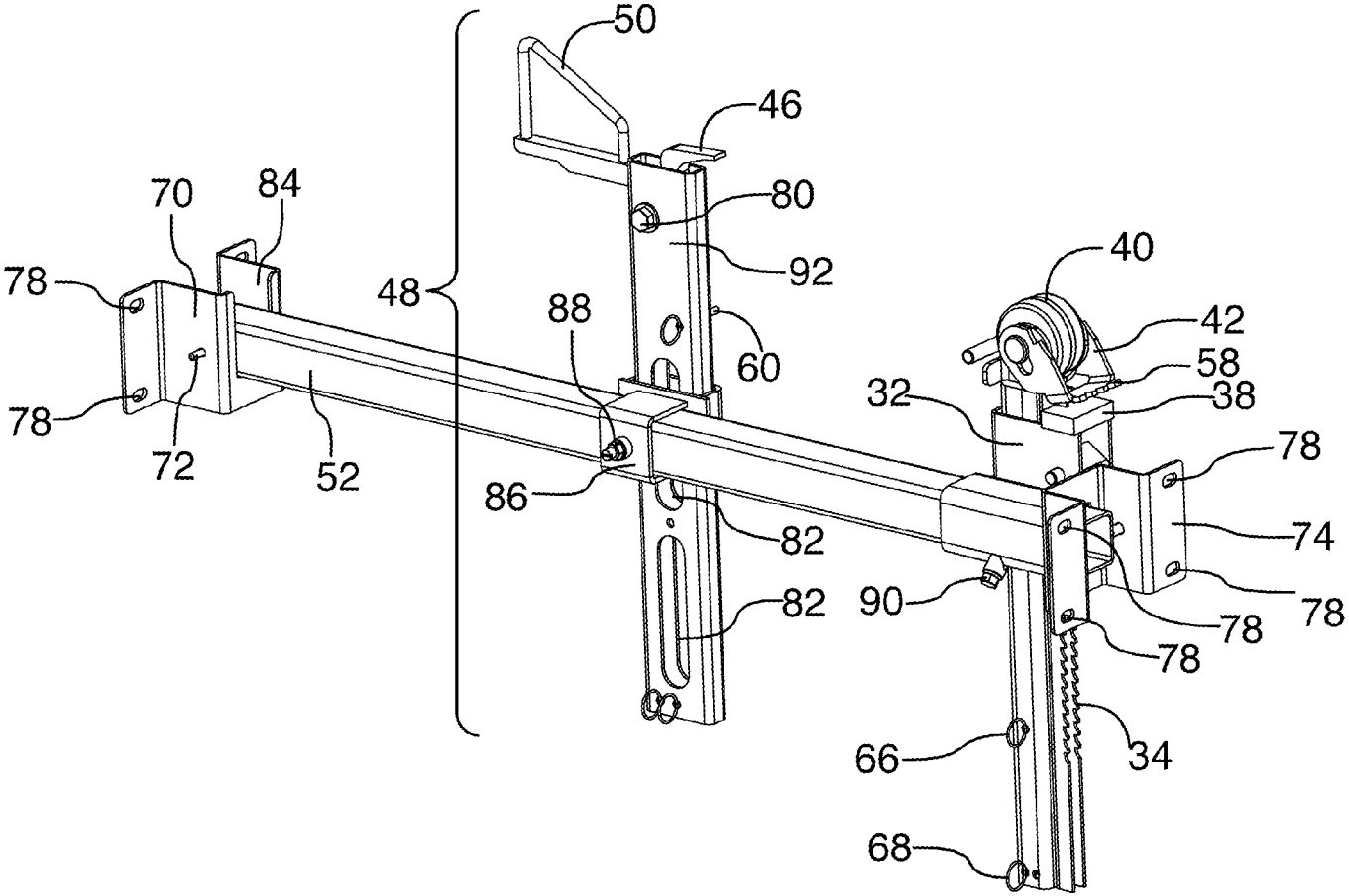
FIG. 3 shows a rear perspective view of the log support/clamping system of FIG. 1.
Figure 4:
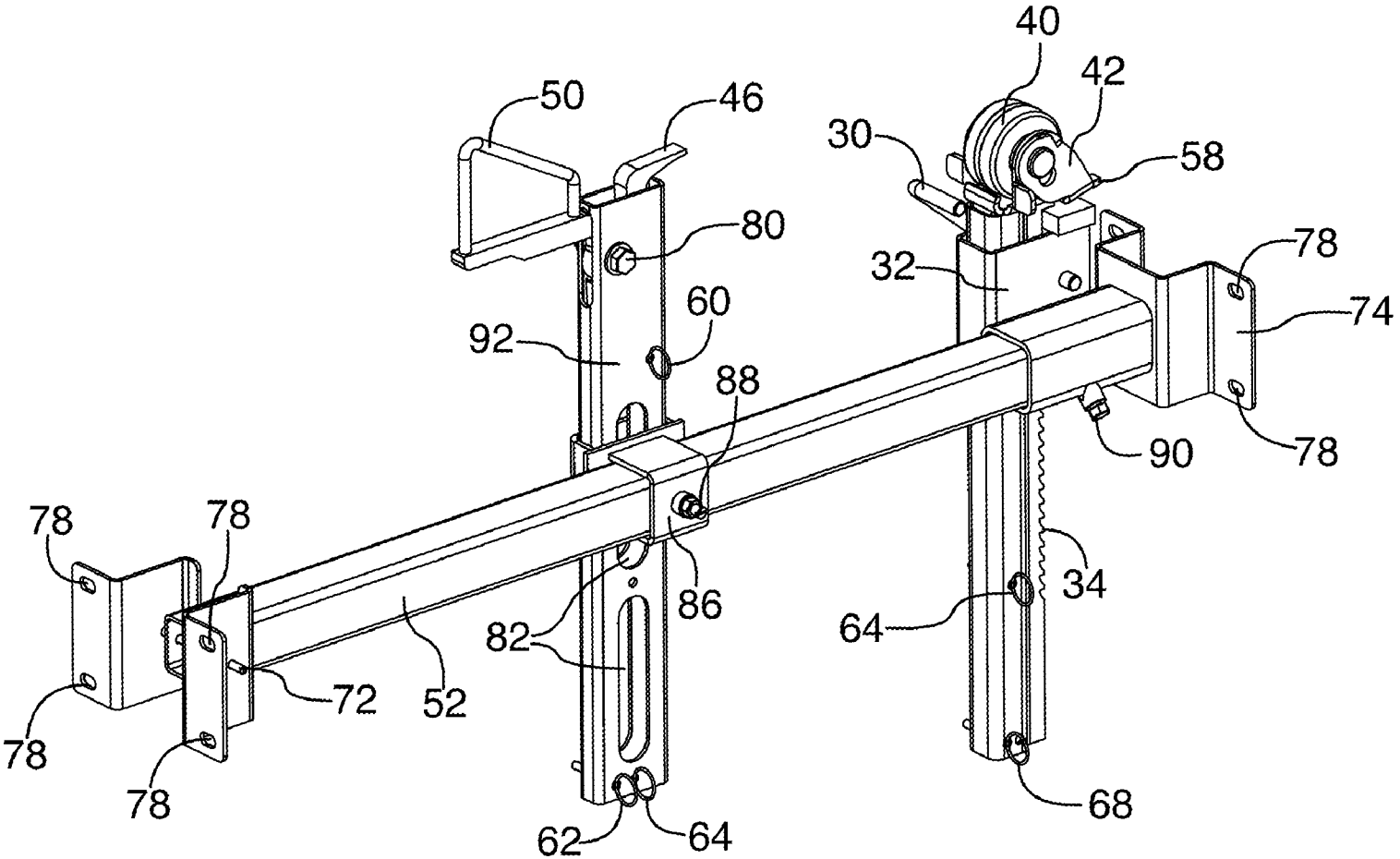
FIG. 4 shows a side perspective view of the log support/clamping system of FIG. 1.

As seen in FIGS. 2 and 3, log dog 48 is removably affixed to the support beam 52, through housing front 56 and back 86 which together receive vertical portion 92. Vertical portion 92 comprises pick 46 and log support 50 at its top end, pin limiters 62, 64 at its bottom end, and adjustment apertures 82 extending vertically therebetween. Apertures 82 lighten the weight of the log dog 48. Housing 56 allows vertical displacement of vertical portion 92 in relation to housing 56, 86 and therefore support beam 52. Housing 86 allows horizontal displacement of log dog 48 in relation to support beam 52, when housing screw 88 is loosened. Vertical portion 92 can thus be displaced vertically within adjustment apertures 82, and can be displaced horizontally, along with housing 56, 86, along support beam 52. When housing screw 88 (FIG. 3) is tightened, housing 86 forms a clamp which affixes the log dog 48 in a horizontal position relative to support beam 52, limiting horizontal displacement relative to support beam 52. A second housing screw, 89 secures log dog 48 in a desired vertical position relative to support beam 52. Alternatively pin limiters (e.g. 60) can secure log dog 48 in a desired vertical position.

Log dog 48 can be removed from support beam 52, by removing pin limiters 62, 64, and lifting vertical portion 92 out of housing 56, 86. Log dog 48, along with housing 56, 86, can also be removed from support beam 52 by removing support beam 52 from sawmill support 72 as described above and displacing vertical portion 92 horizontally beyond the end of support beam 52.

Typically, log dog 48 is adjusted horizontally and vertically in relation to support beam 52 each time a log is clamped. The horizontal and vertical positioning will depend on the size of the logs to be cut. For example, for larger logs, log dog 48 will typically have a horizontal location on support beam 52 that is closer to saw mill support 70, as compared to its positioning for smaller logs. With large logs, both log dog and log rest will each be as far apart from each other and, as close to their respective rails. Vertical displacement will be such that pick 46 will be further away from support beam 52 for larger logs as compared to smaller logs. Once log dog 48 is adjusted for use, finer adjustments for each particular log, and clamping the log can be performed using log rest 54. The log dog 48 freely slides vertically and horizontally. Each time a log is clamped, adjustments are made on both planes. The adjustment made to the log rest 54 as independent of those made with the log dog. As explained in more detail below, an operator first adjusts the log rest 54 and then adjusts the log dog 48 and clamp. The primary similarity in the adjustments made to both the log dog and log rest is that their vertical displacement is a dependant on log size.

Log rest 54 comprises log rest housing 32 which is affixed to support beam 54. Log rest housing 32 comprises clamp housing lock 90 which enables the log rest housing 32 (and thus log rest 54) to be affixed to the support beam 52. Loosening clamp housing lock 90 allows the log rest housing 32 (and thus the entire log rest 54) to be horizontally displaced along support beam 52.

Figure 5:
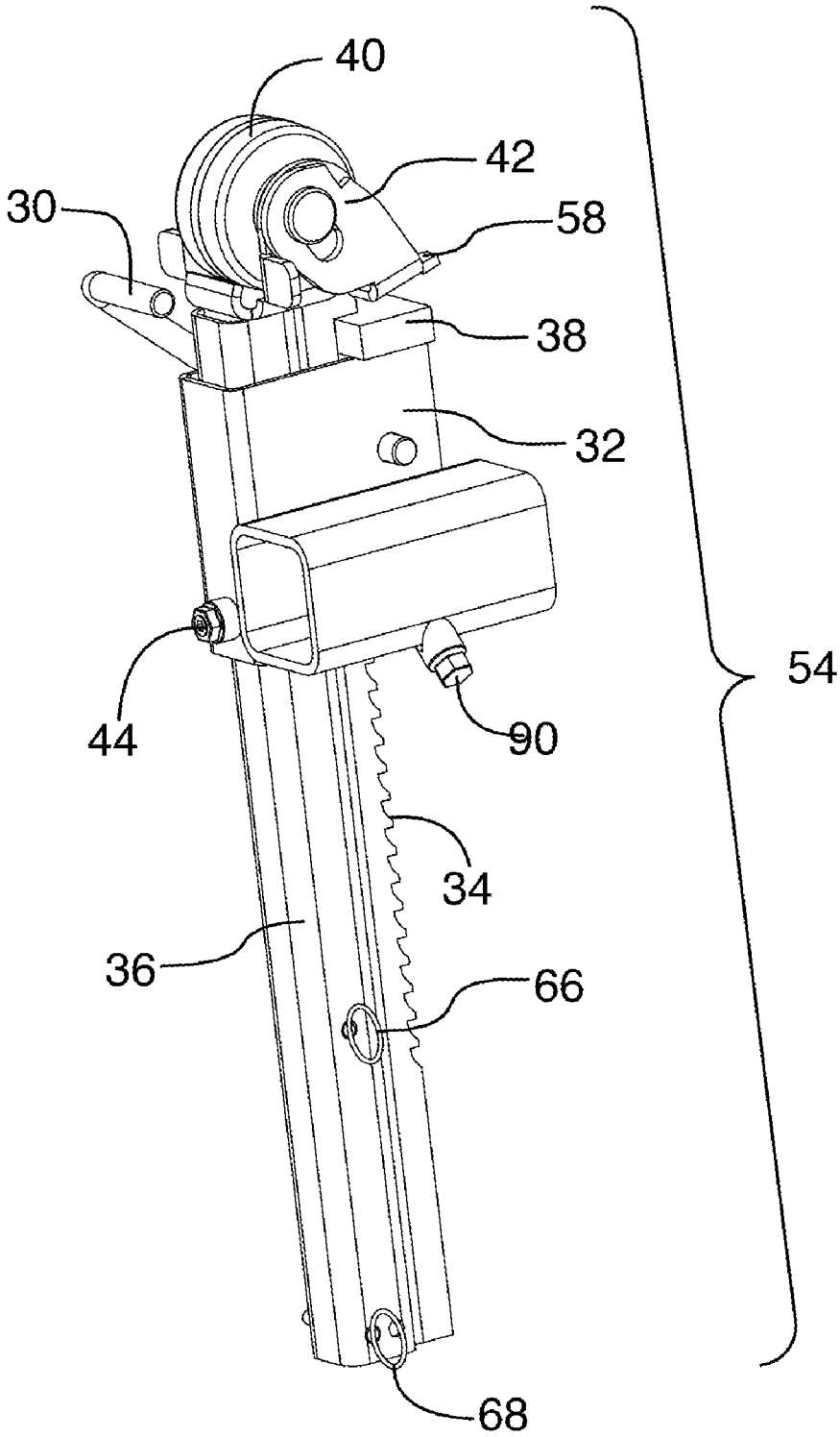
FIG. 5 shows a side perspective view of the log rest assembly portion of the log support/clamping system of FIG. 1, in isolation.
Figure 6:
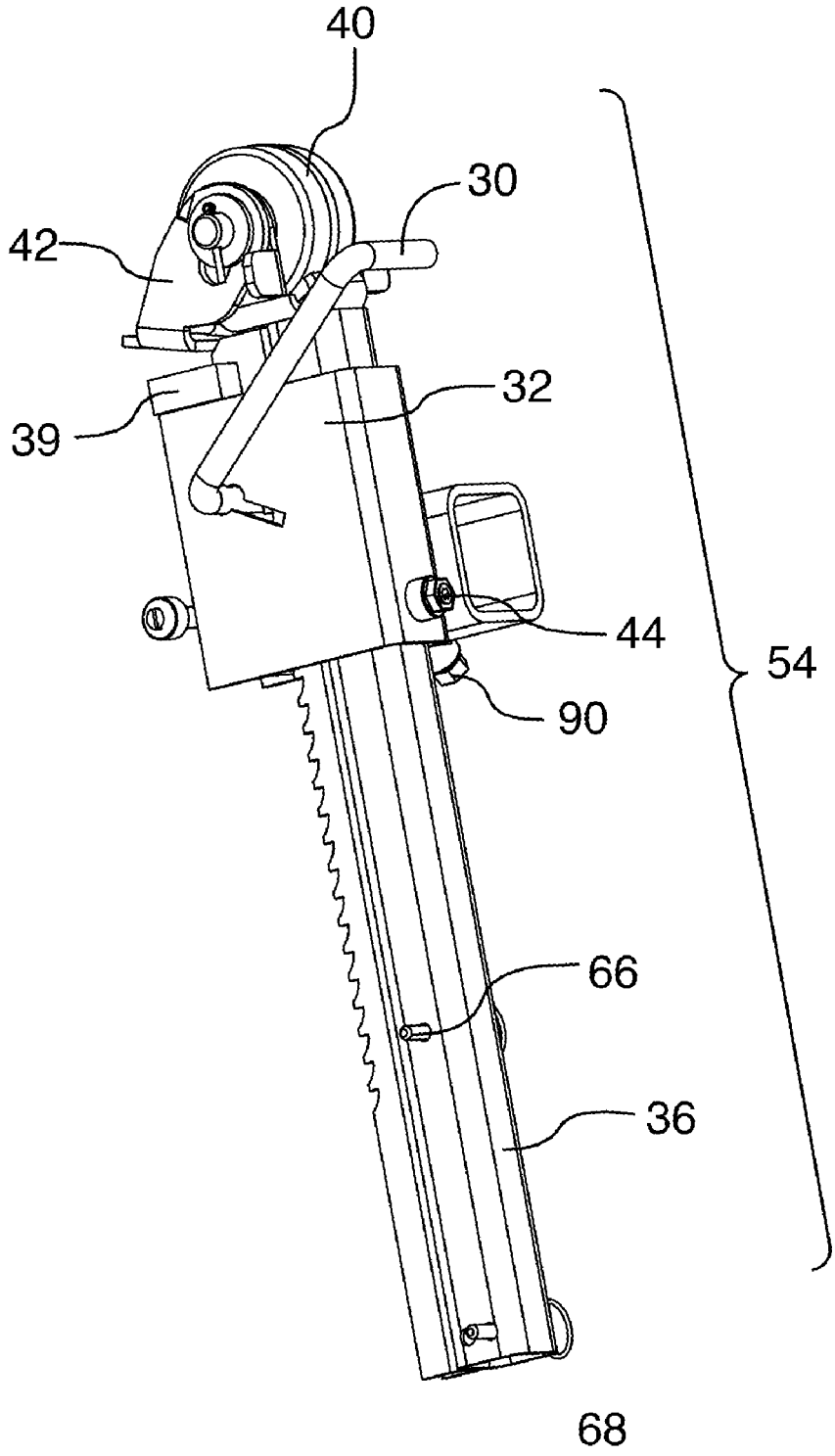
FIG. 6 shows a rear perspective view of the log rest assembly of FIG. 5.
Figure 7:
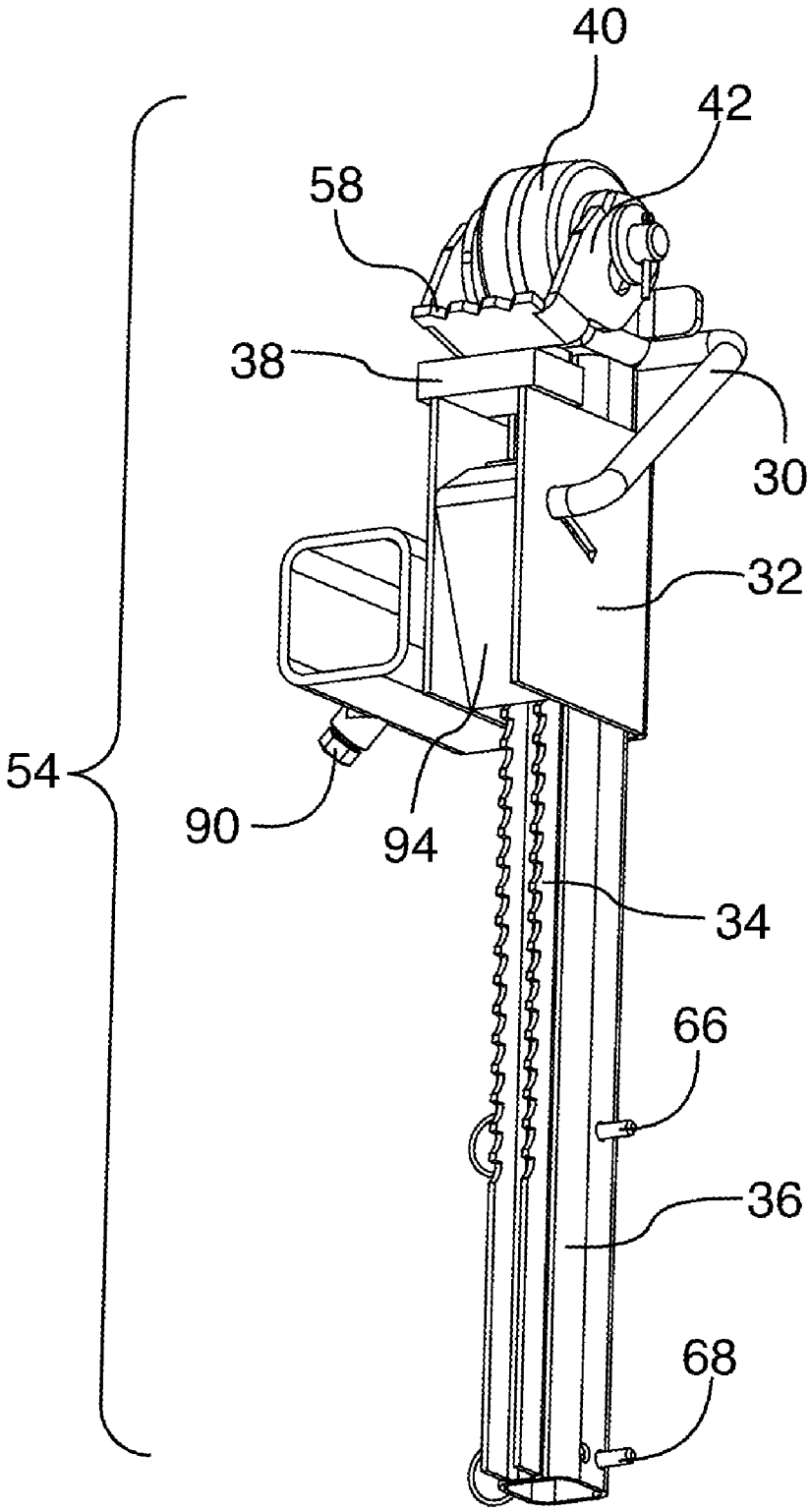
FIG. 7 shows a front perspective view of the log rest assembly of FIG. 5.

As seen in FIGS. 5 to 7, log rest housing 32 houses post 36 which can be vertically displaced relative to log rest housing 32 utilizing ratcheting means. Note that clamp housing lock 90 does not affect vertical displacement of post 36. Rather, log rest housing 32 has handle 30 which, when pivoted along its axis, displaces pawl 94, in turn displacing ratchet teeth 34 and thus post 36 vertically, relative to log rest housing 32. Ratchet teeth 34 aid in locking the ratcheting mechanism at any particular vertical position along post 36. Handle 30 and pawl 94 thus allow for upwards ratcheting motion of post 36, and the locking of post 36 in the selected position. Post 36 can then be displaced in a downwards direction by releasing the pawl 94 by lifting handle 30 from ratchet teeth 34 and allowing the post 36 to fall using gravity or by pushing down on the top of the post 36, for example, by pushing down on wheel 40.

Post comprises horizontal adjustment screw 44, which allows for fine tuning of the horizontal location of post 36 relative to support beam 52, even while log rest housing 32 is secured and horizontally affixed to support beam 52. Post 34 also comprises wheel 40 at its top end, which has an axially rotatable, locking cuff 42 having a cuff tip 58. The lower end of post 36 also comprises pin limiters 66, 68 which prevent the post 34 from so much vertical displacement that it is inadvertently removed out of the top of log rest housing 32.

The log rest is used as follows. The horizontal and vertical location of log dog 48 relative to support beam 52, and the horizontal position of log rest 54 relative to support beam 52 are set to a desired position, based on the size of the logs to be milled. The position is estimated by the user such that the diameter of the log is slightly larger than the distance between the log dog 48 and the log rest 54. The post 36 is set at its lowest position by releasing the ratcheting mechanism and allowing gravity to displace the post, pushing down on wheel 40 if necessary. The log is placed, pushed, or rolled against the log rest, using log support 50 if necessary. Log dog handle 50 is configured such that a downward force on it causes a cam 92 inside to be forced against the pick 46 which, in turn, is pressed into the log. The log is rolled onto the log deck, and rests on the cross bunks (spans between the rails). It is positioned into the area between the log rest 54 and the log dog 48. The log thus comes close to resting on the wheel 40. The user then displaces the post 36 upwards, using the ratcheting mechanism of handle 30 such that the log rest 54 supports the log but is lower than the path along which the blade will travel. Once post 36 is adjusted for correct height, the operator pushes the log against 40, vertically and horizontally adjust 92, lifts handle 50, pushes log dog 52 against the log, lowers handle 50, thereby forcing pick 46 into the log. This allows for clamping of the log between the log dog 48 and the log rest 54. As the clamping gets tighter, pick 46 digs into the side of the log, providing more stability. In this manner, utilizing handle 30, a user is able to clamp the log between the wheel 40 and the pick 46 utilizing one hand. Optionally, where even more stability is required, the user can rotate and lock cuff 42 so that its end 58 (which optionally has teeth (not shown) contacts the log. In this manner, as the clamping gets tighter, both pick 46 and cuff end 58 dig into opposing sides of the log, further stabilizing the log in place. Log rest housing 32 also comprises square block surface 38, which provides support for post 36 as log cuff 42 or wheel 40 digs into the log.

It is to be understood that the present invention is not limited to the embodiments described above, but encompasses any and all embodiments within the scope of the following claims.

TABLE OF ELEMENTS

10 Sawmill
30 Handle
32 Log rest housing
34 Ratchet teeth
36 Post
38 Square block surface
40 wheel
42 rotatable cuff
44 adjustment screw
46 pick
48 log dog
50 log dog handle
52 support beam
54 log rest
56 housing front
58 end
60 pin limiter
62 pin limiter
64 pin limiter
66 pin limiter
68 pin limiter
70 sawmill support
72 sawmill support pin
74 sawmill support
76 sawmill support pin
78 screw holes
80 log support screw
82 apertures
84 sawmill support opening
86 housing back
88 housing screw
89 housing screw
90 clamp housing lock
92 vertical portion of log dog
94 pawl

What is claimed is:

1. A log support and clamp assembly for use in a portable sawmill, comprising:

a horizontal support beam having two ends for affixing to a sawmill, said support beam capable of being affixed to said sawmill at both ends;

a log dog, having a vertical portion generally perpendicular to said horizontal support beam and extending upwards therefrom, and a top end having a pick protruding therefrom;

a log rest assembly having:

a clamp housing affixed to said support beam and horizontally displaceable thereon;

a post connected to or housed within said clamp housing, said post configured in a generally vertical direction and said clamp housing having a ratchet mechanism for raising and lowering the post relative to the horizontal support beam;

wherein a space defined between the log rest assembly and the log dog is adjustable relative to each other.

2. The log support and clamp assembly of claim 1 wherein the post has a wheel at a top end.

3. The log support and clamp assembly of claim 2 wherein the wheel has a rotatable, lockable cuff.

4. A portable sawmill comprising a log support and clamp assembly, wherein the log support and clamp assembly further comprise:

a horizontal support beam having two ends for affixing to said sawmill, said support beam capable of being affixed to said sawmill at both ends;

a log dog, having a vertical portion generally perpendicular to said horizontal support beam and extending upwards therefrom, and a top end having a pick protruding therefrom;

a log rest assembly having:

a clamp housing affixed to said support beam and horizontally displaceable thereon;

a post connected to or housed within said clamp housing, said post configured in a generally vertical direction and said clamp housing having a ratchet mechanism for raising the post relative to the horizontal support beam;

wherein a space defined between the log rest assembly and the log dog is adjustable relative to each other.

5. The portable sawmill of claim 4 wherein the post has a wheel at a top end.

6. The portable sawmill of claim 5 wherein the wheel has a rotatable, lockable cuff.

* * * * *